US005394615A

United States Patent [19]

Hoppe et al.

[11] Patent Number: 5,394,615

[45] Date of Patent: Mar. 7, 1995

[54] LIGHT ARCHERY SIGHT

[76] Inventors: Henry F. Hoppe, 14990 Rome Rd., Manitou Beach, Mich. 49253; Robby P. Geiner, 10311 Lickley Rd., Pittsford, Mich. 49271

[21] Appl. No.: 70,893

[22] Filed: Jun. 3, 1993

[51] Int. Cl.[6] ..... F41G 1/467

[52] U.S. Cl. ..... 33/265; 33/241; 33/242; 124/87

[58] Field of Search ..... 33/241, 242, 265; 124/87; 356/251, 252; 42/103

[56] References Cited

U.S. PATENT DOCUMENTS

| | | | |
|---|---|---|---|
| 2,367,207 | 1/1945 | Flint | 356/252 |
| 2,542,501 | 2/1951 | Fredrickson | 33/265 |
| 2,545,454 | 3/1951 | Fredrickson | 33/265 |
| 2,642,661 | 6/1953 | Fredrickson | 33/265 |
| 2,742,702 | 4/1956 | Willims | 33/265 |
| 3,455,027 | 7/1969 | Perkins | 124/87 |
| 3,816,005 | 6/1974 | Kirschner | 356/251 |
| 4,481,717 | 11/1984 | Kowalski | 124/87 |
| 4,495,705 | 1/1985 | Kowalski et al. | 33/265 |
| 4,554,744 | 11/1985 | Huckenbeck | 33/241 |
| 4,638,565 | 1/1987 | Podany et al. | 33/265 |
| 4,665,622 | 5/1987 | Ioan | 33/241 |
| 4,689,887 | 9/1987 | Colvin | 33/265 |
| 4,805,313 | 2/1989 | Stocker et al. | 33/241 |
| 4,877,324 | 10/1989 | Hauri et al. | 356/251 |
| 4,977,677 | 12/1990 | Troescher, Jr. | 33/265 |
| 4,979,309 | 12/1990 | Oligschlaeger | 33/265 |
| 5,025,564 | 6/1991 | Sanders | 33/241 |
| 5,090,805 | 2/1992 | Stawarz | 356/251 |
| 5,122,932 | 6/1992 | Ziller | 362/32 |

*Primary Examiner*—Thomas B. Will
*Attorney, Agent, or Firm*—Beaman & Beaman

[57] ABSTRACT

A light archery sight using a spot of light reflected on a transparent window for aiming purposes. The window is free of barriers permitting the target and aiming spot to be quickly simultaneously observed. The light aiming spot is reflected from a transparent window obliquely related to the line of sight, and the window may be mounted upon a slide carriage movable in a direction transverse to the light path to vary the elevation of the reflected light, and hence, the line of sight elevation.

11 Claims, 2 Drawing Sheets

LIGHT ARCHERY SIGHT

BACKGROUND OF THE INVENTION

1. Field of the Invention

The invention pertains to archery sights wherein reflected light defines an aiming spot and the light is reflected from a transparent window through which the target is simultaneously viewed.

2. Description of the Related Art

Archery sights mounted upon the bow handle include adjustable supports permitting the sight elevation to be adjusted according to the distance of the target from the archer. Archery sights may simply consist of a pin, perhaps having a shaped end, wherein the target is aligned with the pin end. More sophisticated sights are available wherein a lighted pin, or a dot of light, is used as the sight.

Illuminated or light type archery sights are shown in U.S. Pat. Nos. 4,495,705; 4,689,887; 4,805,313; 4,877,324; 4,977,677; 4,979,309; 5,025,564; 5,090,805 and 5,122,932. The archery sights shown in the above patents utilize light to either illuminate the sight, or light may constitute the sighting spot, itself.

In U.S. Pat. No. 5,090,805 a reticle aiming spot is reflected by a full reflecting mirror upon a partial reflecting mirror, or beam splitter. The archer may view the target through the beam splitter, and simultaneously observe the aiming spot reflected on the beam splitter whereby alignment of the aiming spot with the target will achieve the desired aim and ultimate destination of the projected arrow. While the sight described in this patent has the advantage of utilizing reflected light as an aiming spot, the beam splitter is encased within an elongated housing having light impervious sides, and the sides of the beam splitter housing interfere with observation of the target, and render aiming difficult. Bow sights constructed in accord with the disclosure of this patent are not practical for hunting moving targets, such as deer, as the sides and configuration of the beam splitter housing interfere with the sighting of the moving target and render simultaneous observation of the target and the aiming spot difficult.

OBJECTS OF THE INVENTION

It is an object of the invention to provide an archery sight using a light aiming spot reflected from a transparent window wherein the sight incorporates no lateral obstructions which interfere with the observation of the target, even though the target may be moving.

A further object of the invention is to provide a light archery sight utilizing a beam of light reflected from a transparent window wherein the window constitutes a cantilever supported synthetic plastic transparent strip highly resistant to breakage and is free of lateral obstructions or reinforcement.

Yet another object of the invention is to provide a light archery sight capable of being mounted upon conventional archery sight supports, and which is lightweight and easy to operate, even under adverse conditions.

An additional object of the invention is to provide a light archery sight utilizing an aiming spot formed from a beam of light reflected from an obliquely disposed transparent window wherein the window may be moved toward and away from the archer upon the sight body adjusting the elevation of the aiming spot to accommodate for the distance of the target from the archer.

SUMMARY OF THE INVENTION

The invention includes an elongated body which may be mounted upon conventional archery bow sight supports. Such conventional supports provide for elevational adjustment of the sight, and the sight body in accord with the invention includes a battery operated light source for projecting a beam of light upon an obliquely related transparent window mounted upon the support.

Preferably, the window is disposed in a plane at approximately 45° to the line of the archer's sight and the light beam is located directly above the window for reflection therefrom. The window preferably constitutes a transparent piece of clear plastic attached at one end to the sight body, and unsupported at the other end and lateral sides. A switch mounted upon the bow handle operated by the archer controls energization of the light.

Because the window is not confined within a housing and may be readily observed from all angles possible by the archer when the archer observes a target and raises the bow preliminary to shooting an arrow, the archer can maintain observation of the game, energize the sight light, and quickly observe the aiming spot as reflected from the window. Upon alignment of the game with the aiming spot, the arrow is released. The unobstructed mounting of the window eliminates the possibility of the sight blocking view of the game, as with prior art sighting devices, and the concise rugged configuration and construction of a light archery sight in accord with the invention makes the sight practical for use in overgrown or brush laden areas.

In a modification of the basic embodiment, a carriage slide is mounted upon the sight body to which the transparent window is mounted. Sliding of the carriage upon the body changes the elevation of the location of the reflected aiming spot on the window thereby quickly adjusting the elevation of the sight to accommodate varying distances to the target.

A light archery sight in accord with the inventive concepts is concise in configuration, economical to manufacture, rugged, dependable and economical.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
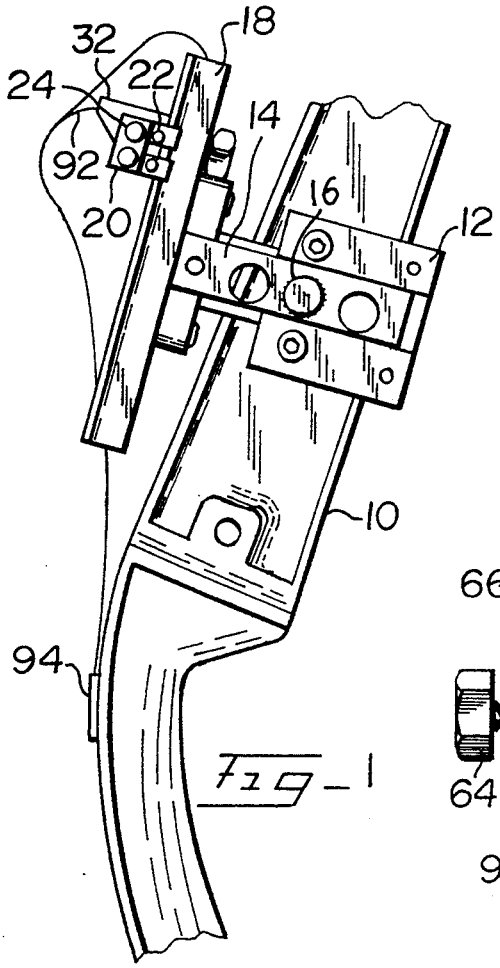
FIG. 1 is a partial elevational left side view of an archery bow handle having a sight in accord with the invention mounted thereon.

With reference to FIG. 1, a bow handle 10 is partially illustrated. The bow handle 10 may be part of any type of conventional archery bow, long bow or compound bow, and includes a sight mounting portion upon which a conventional sight guideway 12 is bolted. The sight support includes a slide 14 adjustably positionable within the guideway 12 and a lock knob and nut 16 will position the slide within the guideway 12 as desired. An elongated guide bar 18 is attached to the outer end of the slide 14, and as will be appreciated from FIG. 8, the guide bar 18 includes dove tailed ways for receiving a carriage 20 adjustably positionable upon the guide bar 18. Bolts 22 mounted on the carriage 20 permit the carriage to be firmly clamped to the guide bar in order to position the carriage thereon. A pair of threaded holes 24 are defined in the carriage 20. The aforementioned sight support structure is conventional with many types of archery sight supports, and forms no part of the present invention.

The light archery sight of the invention is mounted upon the carriage 20 by a threaded shaft 26 threaded into a hole 24, and the shaft is locked in its position by a lock nut 28. A lock nut 30 is also located upon shaft 26 for fixedly positioning the sight body upon the shaft.

The sight body 32 is of an elongated configuration and includes a threaded hole 34 receiving the shaft 26, and in this manner the body 32 is mounted upon the carriage 22. The sight body 32 includes a front end 36 disposed toward the target, a rear end 38 disposed toward the archer, and an oblique surface 40 is defined at the front end of the body 32 disposed at an angle of substantially 45° with respect to the axis of the sight body.

Figure 5:
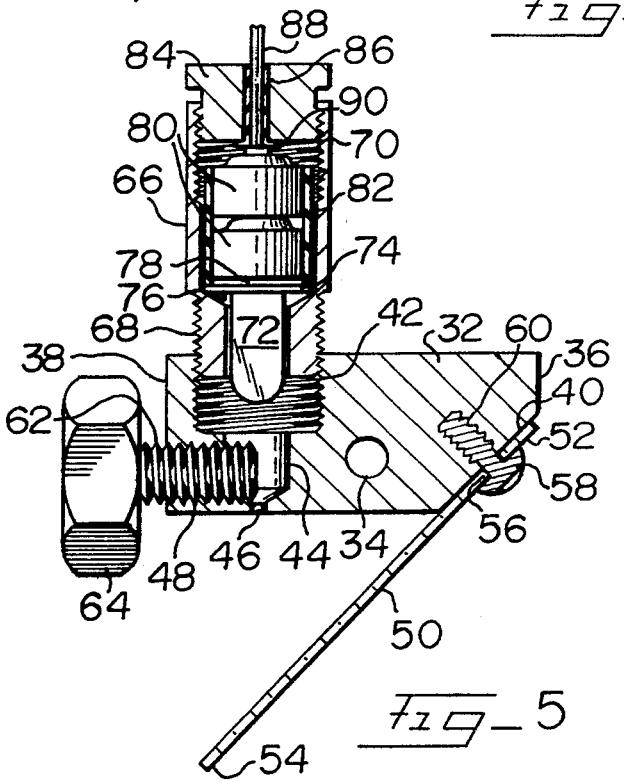
FIG. 5 is an elevational central sectional view.

A threaded bore 42, FIG. 5, is defined in the sight body 32 concentric with a cylindrical light chamber 44 formed in the body, which in turn is concentric to the small light orifice 46 which intersects the sight body lower surface. The amount of light passing through the orifice 46 is controlled by a light gate which includes a threaded bore 48 formed in the body 32, as later described.

The aiming spot, and target, are viewed at the transparent window 50 which is in the form of an elongated strip of transparent plastic material, such as that sold by the General Electric Company under the trademark LEXAN Type HP92S, and the window 50 includes an upper end 52, and a free cantilevered lower end 54. A hole 56 is formed in the upper region of the window for receiving a bolt 58 threaded into hole 60 intersecting surface 40, and the bolt 58 will firmly mount the window 50 on the surface 40 wherein the plane of the window 50 will be obliquely disposed to the longitudinal axis of the sight body 32 at approximately 45°.

The light gate includes a threaded stem 62 received within the threaded bore 48, and the hexagonal head 64 attached to the stem 62 permits the stem to be rotated for regulating the extent of projection of the stem into the light chamber 44. As the end of the stem 62 can be adjusted relative to the orifice 46 the amount of light passing through the orifice 46 can be regulated by rotating head 64 as later described.

The light source for the sight includes a cylindrical housing 66 which is preferably knurled on its exterior surface and includes threads 68 to permit the housing to be threaded into the body bore 42, FIG. 5. The upper portion of the housing 66 includes internal threads 70, and a light emitting diode 72 is located within the lower regions of the housing 66 for projecting a red light into the light chamber 44 and through the orifice 46. The diode 72 includes an electrically insulated base 74, and the diode terminal 76 is grounded to the housing 66, while the diode terminal 78 directly engages the lower battery 80 of a pair of small batteries connected in series.

An electrical insulating dielectric jacket 82 surrounds the batteries 80, and a plug 84 is threaded into the upper end of the housing 66 upon threads 70. Internally, the plug 84 includes the dielectric sleeve 86 receiving the conductor 88 having a terminal 90 defined thereon which engages the upper terminal of the upper battery 80.

Figure 3:
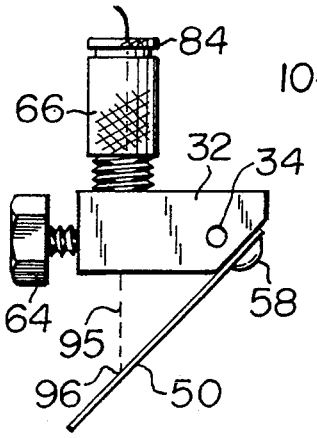
FIG. 3 is a side elevational view of the light archery sight, per se, as taken from the right of FIG. 2.
Figure 4:
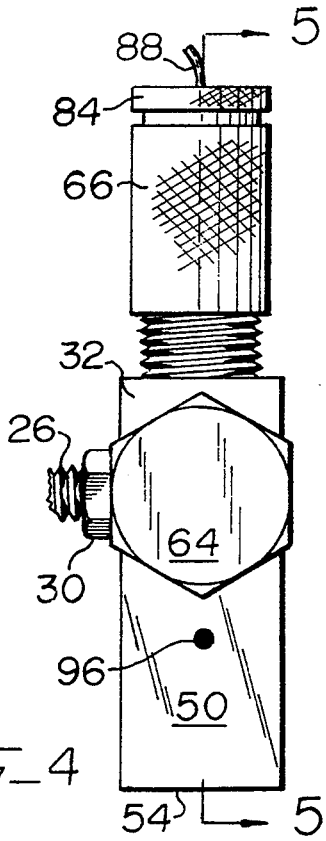
FIG. 4 is an enlarged rear elevational view of the light archery sight in accord with the invention.

A ground wire 92 is connected to a bolt on the sight or sight support structure, FIG. 1, and the conductor 88 and ground wire 92 are connected to a switch 94 mounted upon the bow handle 10 convenient for actuation by the archer. Upon the archer closing the switch 94, the circuit to the light emitting diode 72 is completed and the diode will project a beam of light through the light chamber 44 and orifice 46 along a light path 95, FIG. 3, defining a sight or aiming spot 96 upon the window 50, FIGS. 3 and 4.

The mounting of the described light archery sight on the bow handle 10 will be appreciated from the above description, and the angle of the axis of the body 32 can be adjusted as desired by loosening and tightening the lock nuts 28 or 30. The elevation of the sight body 32 is adjusted by loosening and tightening the bolts 22 to position the sight body upon the guide bar 18.

Figure 2:
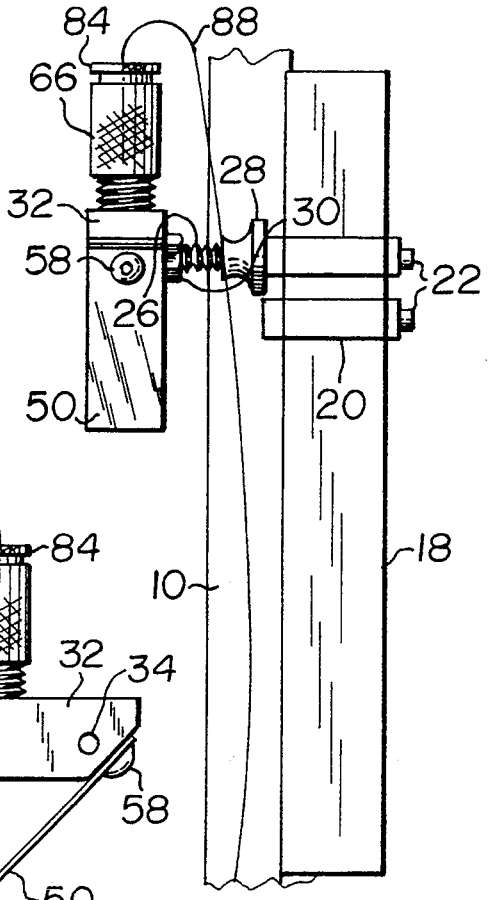
FIG. 2 is a front view of the bow handle and sight as taken from the left of FIG. 1.

As will be appreciated from FIG. 2, the body 32 is offset with respect to the bow handle, and the window 50 may be readily observed from the left by the archer. Upon closing the switch 94, energizing of the diode 72 permits the diode to be observed as reflected upon the window 50 at spot 96, and the archer will align the aiming spot 96 upon the target.

As the window 50 is relatively narrow, for instance about one-half inch in width, and as the window end 54 is unsupported and the window free end and lateral sides are unobstructed, the archer may readily observe the target, even though the target may be running game, and the sight structure does not interfere with the observation of the target. The archer will move the bow until the aiming spot 96 is imposed directly upon the target and the arrow will then be released. The bright red aiming spot 96 is readily observed by the archer, under all lighting conditions, and the brightness or intensity of the reflected spot 96 is regulated by rotating the light gate head 64. The further the stem 62 projects into the lighting chamber 44, the less intense the light at the orifice 46, and when hunting at dusk, and under poor natural light conditions, the light intensity will usually be decreased, while the light intensity is normally increased by backing off the stem 62 under bright sunlight conditions.

As the sight body 32 can be readily removed from the carriage 20, the conventional bow sight can be easily remounted on the carriage, and the light archery sight of the invention requires no permanent modification to the bow handle. For instance, the switch 94 may be mounted upon the bow handle by a Velcro patch.

Figure 6:
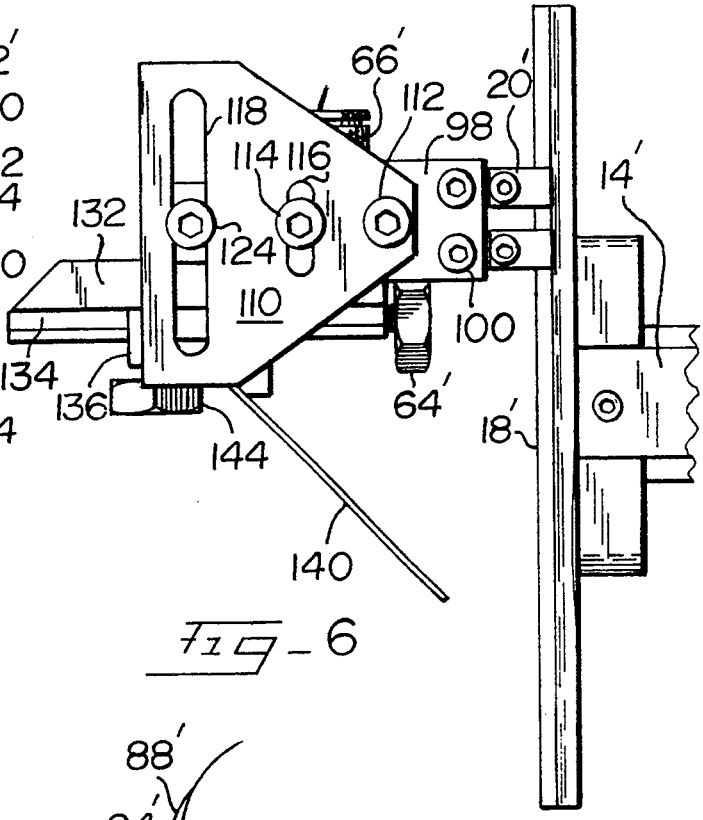
FIG. 6 is a left side elevational view of another embodiment of a light archery sight utilizing the inventive concepts.
Figure 7:
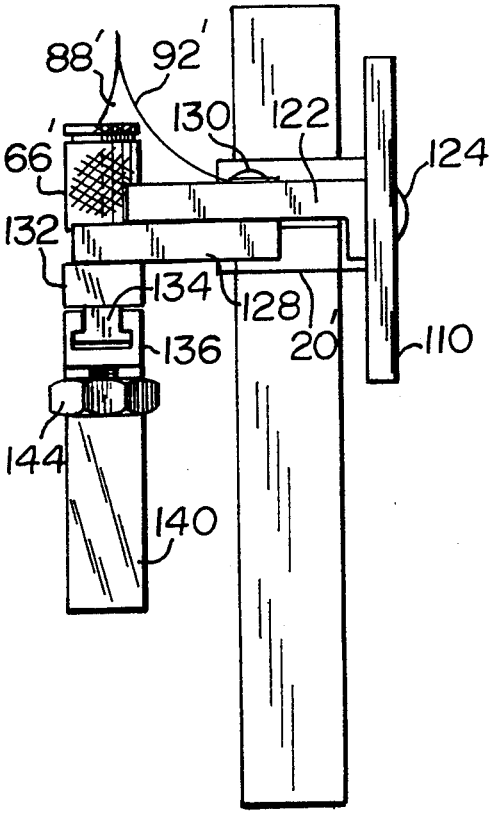
FIG. 7 is a front elevational view of the embodiment of FIG. 6 as taken from the left thereof.

A modification of the light archery sight in accord with the inventive concepts is illustrated in FIGS. 6–9, and in these figures components similar to those previously described are represented by primed reference numerals. In the embodiment of FIGS. 6–7, a plate 98 is bolted to the carriage 20' by a pair of bolts 100, and an adjustment plate 110 is adjustably mounted upon the plate 98 by a pivot screw 112 and an adjustment screw 114. The adjustment screw 114 is received within an elongated slot 116 formed in the plate 110, and the presence of the slot 116 permits the plate 110, and light archery sight mounted thereon, as later described, to be angularly adjusted relative to the plate 98 as the plate 110 is capable of pivoting about the screw 112.

Figure 8:
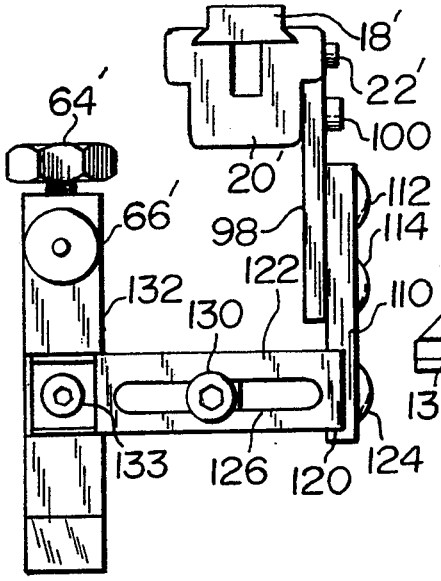
FIG. 8 is a top plan view of the embodiment of FIG. 6.

An elongated slot 118 is formed in the plate 110, and a groove 120 is formed in the plate 100 symmetrically related to the slot 118 as will be appreciated from FIG. 8. A slide 122 of an L-configuration, FIG. 7, is received within groove 120 and the slide is adjusted relative to the plate 110 by the screw 124 extending through the slot 118. In this manner, the elevation of the slide 122 may be regulated.

A slot 126, FIG. 8, is formed in the slide 122 and an extension 128 disposed below the slide 122 receives a bolt 130 extending through slot 126 for adjusting the offset of the sight relative to the bow handle.

The elongated sight body 132 is mounted upon the extension 128 by bolt 133, FIG. 8, and the length of the housing 132 is greater than the length of the sight housing 32 described with respect to FIGS. 1–5.

At its lower regions, the housing 132 is formed with a T-head guide or track 134 best shown in FIG. 7 and the guide 134 extends between the front and rear ends of the housing 132. A slide carriage 136 includes a T-shaped groove for cooperating with the guide 134 whereby the slide carriage 136 is capable of moving along the guide 134 for adjustment purposes. An oblique surface 138 is defined upon slide 136 disposed at approximately 45° to the axis of the housing 132, and a transparent plastic window 140 is attached upon the slide 136 by bolt 142 wherein the window 140 will be firmly mounted upon the slide 136.

Adjustment of the slide 136 on the housing 132 is regulated by the locking bolt 144 threadably mounted into the slide 136 having a stem 146 for bearing against the lower end of the guide 134. Loosening of the locking bolt 144 permits the slide 136 to be adjusted along the guide, while tightening of the bolt fixes the position of the slide carriage 136 on the housing 132. The threaded stem 146 extending from the bolt head 144 engages the underside of the guide.

The light source housing 66' mounted upon the housing 132 is identical to that previously described, as is the operation of the light gate through the head 64'. Energizing of the light emitting diode, not shown, located within housing 66' causes the light to pass through the housing along a light line 148, FIG. 9, to produce an aiming spot 150 upon the window 144 observable by the archer located at the left, FIG. 9, of the sight housing.

Figure 9:
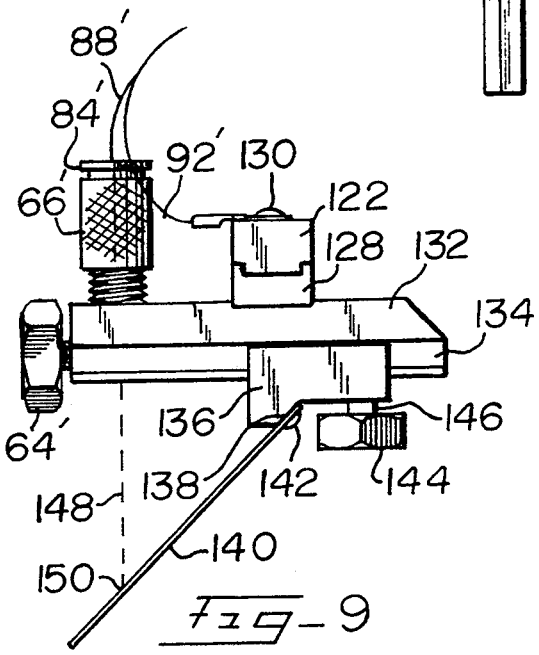
FIG. 9 is a side elevational view of the light archery sight of FIG. 7 as taken from the left, the supporting structure for the sight not directly associated with the sight body being omitted for purpose of illustration.

In the embodiment of FIGS. 6 and 7, the elevation of the sight may be very quickly varied by unloosening the lock bolt 144 and sliding the carriage 136 along the guide 134. The further to the left the slide 136 is moved, FIG. 9, the higher up on the window 140 the sight spot 150 occurs, and a lower sight spot is achieved by moving the slide carriage 136 forward, to the right as shown in FIG. 9. In this manner, the elevation of the aiming spot may be very quickly changed by the archer to accommodate a rapidly changing distance to the target, as is necessary when stalking moving game.

It will be appreciated that the light archery sight in accord with the invention is relatively economical to manufacture, and is very easy to use in that no obstruction to viewing of the light reflective window exists. By forming the windows 50 or 140 of a thin strip of high strength synthetic plastic transparent material, the likelihood of damage to the window is minimized, and a light aiming spot is produced which is easily used even by inexperienced archers.

It is appreciated that various modifications to the inventive concepts may be apparent to those skilled in the art without departing from the spirit and scope of the invention.

We claim:

1. A light archery sight through which an archer observes a target along a line of sight characterized by its ease of viewing and rapid unobstructed sighting adapted to be mounted upon a bow handle comprising, in combination, a support adapted to be mounted upon a bow handle, a sight body mounted upon said support having a front end and a rear end, a clear cantilever mounted open light reflective window formed of high strength flexible synthetic plastic having a body mounted end mounted on said body, a body remote free end and free visually unobstructed lateral sides, a light source mounted on said body producing a beam of light directly exposed to said window for reflection thereof in the direction of the archer, said window being obliquely related to the archer's line of sight whereby the reflection of said light on said window and the target may be simultaneously observed by the archer.

2. In a light archery sight as in claim 1, light beam intensity adjustment means mounted on said body adjustably obscuring said beam of light for regulating the intensity of the light beam exposed to said window.

3. In a light archery sight as in claim 2, said light source including a housing removably mounted upon said body, a lamp, battery and conductors located within said housing, and a switch operatively connected to said conductors for selectively connecting said battery to said lamp to illuminate said lamp.

4. In a light archery sight as in claim 3, said switch including means for mounting the switch upon the bow handle.

5. A light archery sight through which an archer observes a target along a line of sight characterized by its ease of viewing and rapid unobstructed sighting adapted to be mounted upon a bow handle comprising, in combination, a support adapted to be mounted upon a bow handle, an elongated sight body mounted upon said support having a longitudinal axis, a front end and a rear end, an elongated guideway defined on said body substantially parallel to said axis extending between said ends, a slide mounted on said guideway for selective movement relative to said body, releasable locking means interposed between said body and said slide to selectively lock said slide relative to said body, a clear open light reflective window having a first end attached to said slide and a second free end obliquely extending toward the archer, a light source mounted on said body producing a beam of light directly exposed to said window for reflection therefrom in the direction of the archer, said window being obliquely related to said body axis and the length of said guideway and the archer's line of sight whereby the beam of light reflected on said window and the target may be simultaneously observed by the archer and longitudinal adjustment of said slide on said guideway varies the elevation of the beam of light reflected on said window.

6. In a light archery sight as in claim 5, said reflective window comprising a panel of clear planar synthetic plastic.

7. In a light archery sight as in claim 6, said reflective window being formed of a high strength flexible strip of synthetic plastic.

8. In a light archery sight as in claim 7, light beam intensity adjustment means mounted on said body adjustably obstructing said beam of light for regulating the intensity of the light beam exposed to said window.

9. In a light archery sight as in claim 5, said light source including a housing removably mounted upon said body, a lamp, battery and conductors located within said housing, and a switch operatively connected to said conductors for selectively connecting said battery to said lamp to illuminate said lamp.

10. In a light archery sight as in claim 9, said switch including means for mounting the switch upon the bow handle.

11. A light archery sight through which an archer observes a target along a line of sight characterized by its ease of viewing and rapid unobstructed sighting adapted to be mounted upon a bow handle comprising, in combination, a support adapted to be mounted upon a bow handle, an elongated sight body mounted upon said support having a longitudinal axis, a front end and a rear end, an elongated guideway defined on said body substantially parallel to said axis extending between said ends, a slide mounted on said guideway for selective movement relative to said body, releasable locking means interposed between said body and said slide to selectively lock said slide relative to said body, a clear open light reflective window having a first end attached to said slide and a second free end obliquely extending toward the archer, a light source mounted on said body producing a beam of light directly exposed to said window for reflection therefrom in the direction of the archer, said window being obliquely related to said body axis and the length of said guideway and the archer's line of sight whereby the beam of light reflected on said window and the target may be simultaneously observed by the archer and longitudinal adjustment of said slide on said guideway varies the elevation of the beam of light reflected on said window, said support including pivot means interposed between said support and said sight body having a pivot axis substantially perpendicular to said body axis for selectively pivoting said sight body relative to said support.

* * * * *